US007746001B2

(12) United States Patent
Francis, Jr.

(10) Patent No.: US 7,746,001 B2
(45) Date of Patent: Jun. 29, 2010

(54) PLASMA GENERATOR HAVING A POWER SUPPLY WITH MULTIPLE LEAKAGE FLUX COUPLED TRANSFORMERS

(75) Inventor: Ralph M. Francis, Jr., Racine, WI (US)

(73) Assignee: Plasma Technics, Inc., Racine, WI (US)

( * ) Notice: Subject to any disclaimer, the term of this patent is extended or adjusted under 35 U.S.C. 154(b) by 435 days.

(21) Appl. No.: 11/741,144

(22) Filed: Apr. 27, 2007

(65) Prior Publication Data

US 2008/0265780 A1 Oct. 30, 2008

(51) Int. Cl.
*H05B 31/26* (2006.01)

(52) U.S. Cl. ..... 315/111.51; 315/111.71; 315/291; 315/224

(58) Field of Classification Search ..... 315/111.21, 315/111.71, 111.5, 111.714, 111.51, 278, 315/282, 274, 312, 276, DIG. 2, 224, 291
See application file for complete search history.

(56) References Cited

U.S. PATENT DOCUMENTS 7,242,151 B2 * 7/2007 Chan et al. ..... 315/278

* cited by examiner

*Primary Examiner*—Douglas W Owens
*Assistant Examiner*—Jae K Kim
(74) *Attorney, Agent, or Firm*—Quarles & Brady, LLP; George E. Haas

(57) ABSTRACT

A plasma generating apparatus includes a plurality of discharge cells in which a gas is excited by a high frequency excitation signal produced at an inverter. Each of a plurality of transformers couples the excitation signal from the inverter to one of the discharge cells, thereby forming a separate resonant circuit that has a resonant frequency. A gap in the transformer core creates a stray magnetic field outside the transformer. The plurality of transformers are in close proximity to each other so that the stray magnetic field from one transformer is coupled to at least one other transformer. Coupling the stray magnetic fields between transformers results in each resonant circuit resonating at the same frequency.

18 Claims, 3 Drawing Sheets

FIG. 5
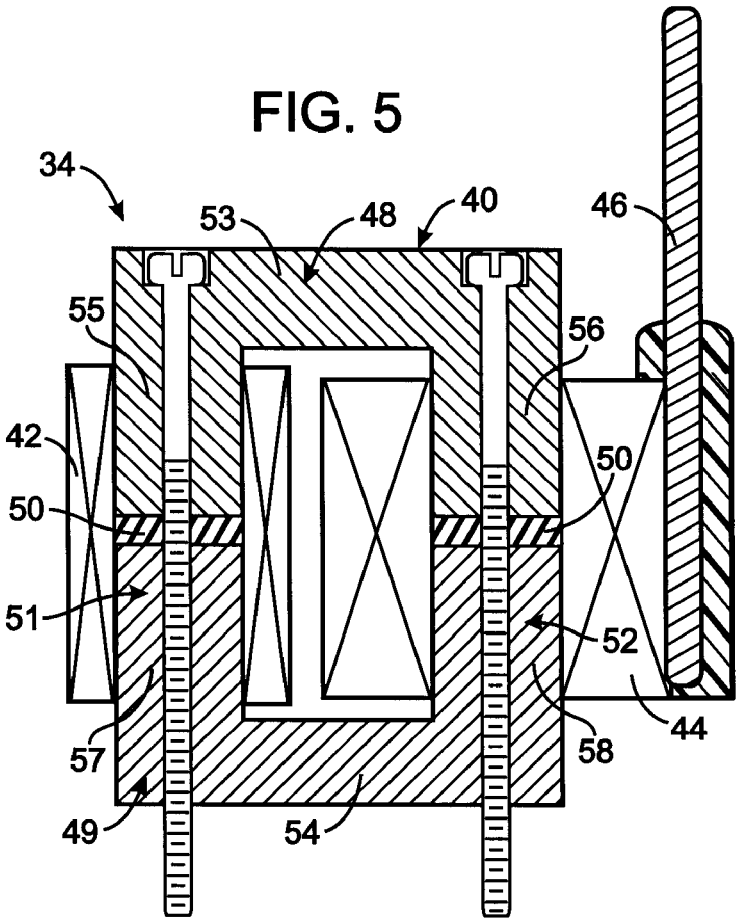
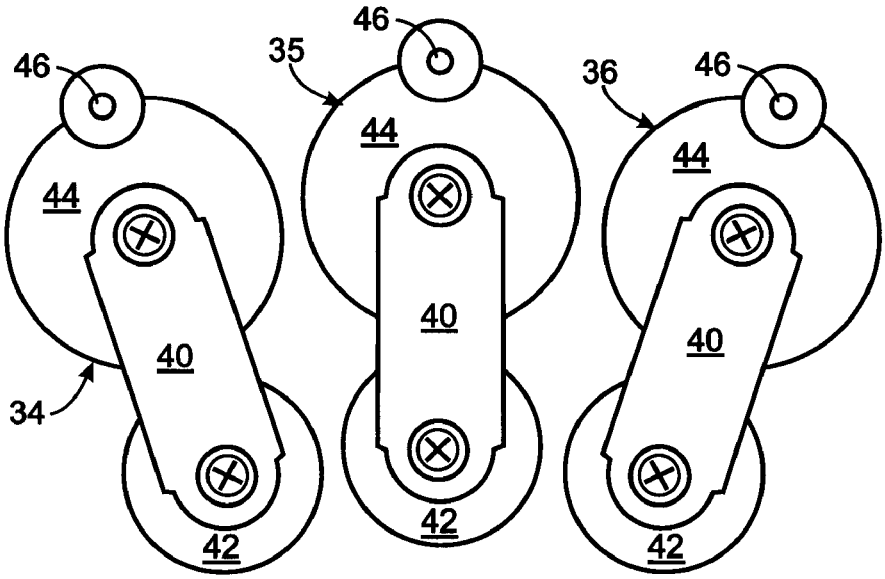
FIG. 6

PLASMA GENERATOR HAVING A POWER SUPPLY WITH MULTIPLE LEAKAGE FLUX COUPLED TRANSFORMERS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to plasma discharge devices, such as for generating ozone, for example; and more particularly to the high voltage power supply for such plasma discharge devices.

2. Description of the Related Art

High energy plasmas are used for a variety of purposes, such as ionizing gas for the generation of ozone or to reduce undesirable nitrogen oxide automobile emissions. FIG. 1 shows a block diagram of a conventional apparatus for generating ozone and is typical of most equipment for generating a plasma with different types of gases. The high volume plasma generator 10 comprises a plurality of plasma discharge cells 12, 13, and 14 each having the schematic design shown for the first cell 12. The plasma discharge cell includes a chamber 16 containing the gas that is to be excited to produce the plasma. The chamber may be closed or, as is the case for an ozone generator, may have a passageway into which oxygen enters and the generated ozone exits. A pair of electrodes 17 and 18 are spaced apart on opposite sides of the chamber 16. When a high voltage is applied across the electrodes, the gas within the chamber 16 is excited, thereby producing the plasma that coverts the incoming oxygen ($O_2$) into ozone ($O_3$). Each plasma discharge cell exhibits a large capacitance load.

The plasma discharge cells 12-14 are driven by a power supply which receives alternating electric current at an input to an inverter 20. The inverter 20 converts the line frequency of the input electric current to a higher frequency suitable for exciting the gas of interest. The output of the inverter 20 is coupled by an inductor/choke 22 to a set of high voltage transformers 24, 25, and 26 connected in parallel. Each transformer 24, 25, and is associated with a different one of the plasma discharge cells 12, 13, and 14, respectively.

The capacitive load of each plasma discharge cell 12-14 is reflected through the respective high voltage transformer 24-26 and the choke 22 to the electronics of the inverter 20. That capacitive load can vary dynamically due to manufacturing tolerances of the plasma generator, as well as variation of the pressure, temperature, and flow rate of the gas being excited. The combination of that capacitive load along with the inductance and resistance of the associated power supply branch form a separate series resonant circuit for each plasma discharge cell. Although those resonant circuits have identical designs to theoretically resonant at the same frequency, the manufacturing tolerances and dynamic gas parameter variations cause each circuit branch to have a different resonant frequency. Nevertheless a single inverter 20 is employed to simplify tuning of the resonance and to eliminate beat frequencies that would exist if multiple inverters were employed in the same plasma generator.

A disadvantage with such conventional power supplies for multiple plasma discharge cells is the relatively large size of the magnetic components, i.e. the choke 22 and transformers 24-26, which significantly add to the cost and weight of the apparatus.

Furthermore, conventional design practice dictates that each transformer for a multiple cell plasma generator be constructed so that its primary and secondary coils are tightly coupled magnetically to reduce stray magnetic fields by minimizing the internal flux leakage. The sum of the transformer leakage inductance and the external choke inductance creates an aggregate inductance that ultimately balances the capacitance of the associated plasma discharge cell. In other words, each transformer has a core that maximizes the conductance of magnetic flux between the primary and secondary coils.

Furthermore, standard engineering practice is to physically separate the transformers 24-26 and the choke 22 by an amount that minimizes the stray magnetic field coupling between those components and to the enclosure of the power supply. Metal objects within such stray magnetic fields become heated to undesirable temperatures. However, separating the magnetic components from each other and from other metal objects within the apparatus has the drawback of requiring a significant amount of empty space within the device. Therefore, conventional design practice dictates that it is desirable to tightly couple the primary and secondary coils of each transformer so as to minimize the stray fields originating from the component.

SUMMARY OF THE INVENTION

A plasma generator includes a plurality of plasma discharge cells for exciting a gas to produce a plasma. A signal generator produces an excitation signal having a high frequency, which is between 2 kHz and 30 kHz for ozone generators. The excitation signal is applied to a separate transformer for each plasma discharge cell.

Each transformer has a ferromagnetic core on which is wound a primary coil that is connected to the generator. Also wound on the core is a secondary coil connected to one of the plasma discharge cells, thereby forming a resonant circuit having a resonant frequency. Considered individually, each resonant circuit typically has a different resonant frequency due to component manufacturing tolerances and variation in the dynamic operating conditions of the respective plasma discharge cell. The core has at least one gap, thereby producing a stray magnetic field outside the transformer. The transformers are placed in close proximity to each other so that the stray magnetic field from one transformer is coupled to at least one other transformer.

During operation of the plasma generator, the leaky coupling of a given transformer allows the stray magnetic fields from the adjacent transformers to influence the resonant frequency of the resonant circuit containing the given transformer. The present invention intentionally cross couples the stray magnetic fields among the plurality of transformers which results in circuits resonating at substantially the same frequency. This enables a common signal generator to produce a single excitation frequency that efficiently drives all the plasma discharge cells.

In the preferred embodiment of each transformer, the ferromagnetic core is annular with opposing first and second side legs and first and second cross legs providing separate flux paths between the side legs. The primary coil is wound around the first side leg and the secondary coil is wound around the second side leg, which separates the coils and further increases the loose magnetic coupling there between.

Preferably the transformer core is formed by a pair of U-shaped sections. The first U-shaped section includes a first leg and a second leg, parallel to each other. The second U-shaped section has a third leg in a spaced apart alignment with the first leg and has a fourth leg in a spaced apart alignment with the second leg. Thus two gaps are created between the legs of the first and second U-shaped sections. The first and third legs combine to form the first side leg of the core, while the second and fourth legs combine to form the second side leg.

BRIEF DESCRIPTION OF THE DRAWINGS

FIG. 5 is a cross sectional view along line 5-5 in FIG. 3;

FIG. 6 illustrates one arrangement of three transformers according to the present invention;

DETAILED DESCRIPTION OF THE INVENTION

Figure 1:
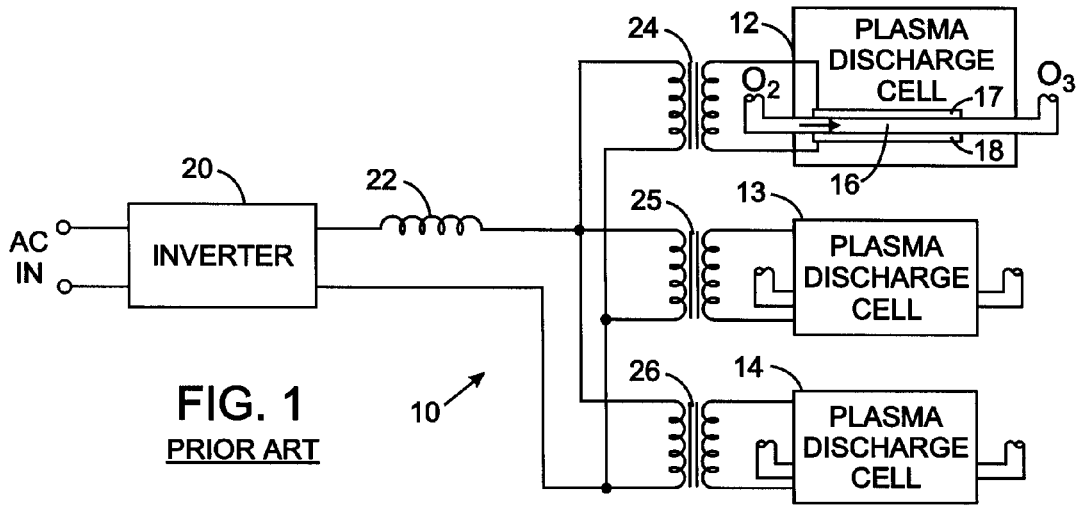
FIG. 1 PRIOR ART
FIG. 1 is a schematic electrical diagram of a previous plasma discharge device.
Figure 2:
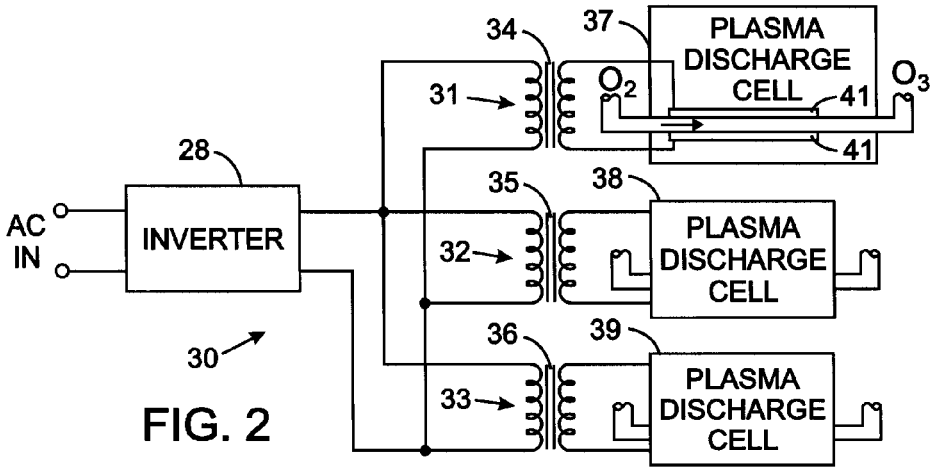
FIG. 2 is a schematic electrical diagram of a plasma discharge device incorporating the present invention.

With reference to FIG. 2, a plasma generator 30 according to the present invention has a conventional inverter 28 with a high frequency output (e.g. 2 kHz to 30 kHz) that is connected directly to the primary coil of a separate transformer 34, 35, and 36 for each of three plasma discharge cells 37, 38, and 39, respectively. It should be understood that the present invention has applicability to a plasma discharge system having two or more plasma discharge cells and thus could have a different number of cells and transformers than is shown in the drawings. The term "directly connected" as used herein means that the associated components are electrically connected to one another without the intervention of any impedance, other than that inherently present in any conductor or cable. Each transformer 34-36 couples the inverter 28 to the electrodes 41 within one of the plasma discharge cells 37-39. As noted previously, each plasma discharge cell 37-39 exhibits a significant capacitive load. The combination of a transformer 34, 35, and 36 and the associated plasma discharge cell 37, 38, and 39, respectively, forms a branch 31, 32 and 33 of the electrical circuit for the plasma generator 30. Each branch 31, 32 and 33 is a separate resonant circuit.

Figure 3:
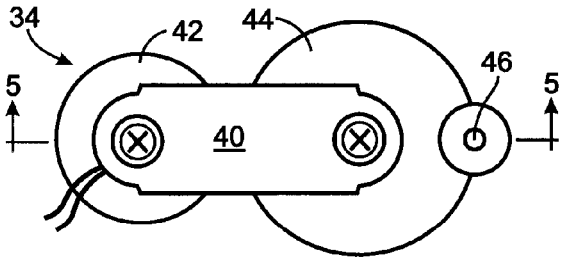
FIG. 3 is a top view of a transformer used in the present power supply for a plasma discharge device.
Figure 4:
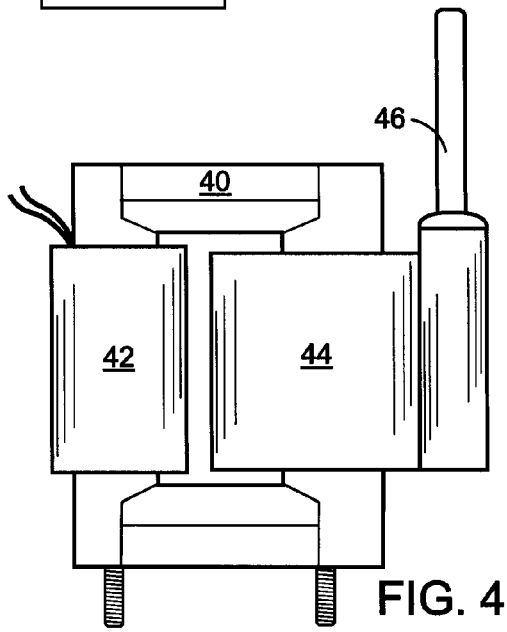
FIG. 4 is a side view of the transformer.

FIGS. 3, 4 and 5 depict the first transformer 34 with the understanding that the other transformers 35 and 36 have an identical construction. The first transformer 34 comprises a rectilinear, annular core 40 on which a primary coil 42 and a secondary coil 44 is mounted. The turns ratio of the primary and secondary coils is selected to increase the voltage of the excitation signal from the inverter to the level necessary to excite the gas and produce a plasma in the respective discharge cell. The core 40 has a first side leg 51 and second side leg 52 parallel to each other on opposite sides of the core with one end of those first and second side legs being connected by a first cross leg 53 and the other ends of the side legs being connected by a second cross leg 54. The first and second cross legs 53 and 54 provide flux paths between the first and second side legs 51 and 52.

With particular reference to FIG. 5, the core 40 comprises first and second U-shaped sections 48 and 49, respectively, both of which are fabricated of a ferromagnetic material commonly used in transformer cores. The upper, first section 48 comprises the first cross leg 53 and first and second substantially parallel section legs 55 and 56. The lower, second section 49 comprises the second cross leg 54 and third and fourth substantially parallel section legs 57 and 58. When the core 40 is assembled the core sections are placed facing each other with the first section leg 55 aligned with the third section leg 57 and the second section leg 56 aligned with the fourth section leg 58.

The first side leg 51 extends the primary coil 42 while the second side leg 52 extends the secondary coil 44. Preferably the side legs have a circular cross section to facilitate winding the wires of each coil. One end of the wire forming the secondary coil 44 terminates at a high voltage terminal 46 for connection an electrode in the plasma discharge cell. In the exemplary transformer, the other end of the wire for the secondary coil 44 is attached to the transformer core 40, which is connected to the circuit ground of the plasma generator. The other plasma discharge cell electrode also is connected to the circuit ground. In an alternative embodiment, a second terminal is provided for the other end of the secondary coil.

The core 40 is intentionally designed to provide a loose electromagnetic coupling between the first and second sections 48 and 49, and between the primary and secondary coils 42 and 44. Specifically, those core sections are spaced apart by bodies 50 of electrical insulating material, that is up to one-quarter inch thick, for example. This creates a gap between the two core sections 48 and 49 around which the magnetic fields must bridge to couple the two core sections. In should be understood that at very high frequencies, the gaps can be reduced in thickness and even eliminated if sufficient leakage flux and significant stray magnetic fields still exist. This construction thereby creates the electrical equivalence of a choke in the circuit of the transformer, thus providing a high leakage inductance. Whereas conventional design wisdom dictates that the transformer core not have gaps in order to provide a tightly coupled transformer with minimum flux leakage, the present design intentionally incorporates gaps to create inductance leakage or leakage flux to balance the capacitance of the associated plasma discharge cell. As a result of that leakage flux, a significant stray magnetic field is generated outside the transformer.

Conventional design practice also is contradicted with respect to positioning a plurality of transformers in a plasma generator with multiple discharge device cells, as shown in FIG. 2. Specifically, standard engineering practices dictate that transformers, which are loosely coupled and thus produce large stray magnetic fields, should be spaced far apart from each other and from other metal objects. That practice prevents the stray magnetic fields emitted by one transformer from being coupled to another transformer or metal component.

Instead, as shown in FIG. 6, the three transformers 34, 35, and 36, for the present plasma generator 30 in FIG. 2 are placed close together so that their stray magnetic fields are coupled into one or more adjacent transformer. Specifically, the transformers are aligned so that their secondary coils 44 are adjacent each other and face in the same direction (e.g. upward in the drawing), and the primary coils 42 are adjacent each other facing in the opposite direction. Preferably the primary coils 42 are spaced apart by the same distance as the secondary coils 44, but that does not have to be the case. Because of the different diameters of the primary and secondary coils, the array of transformers forms an arc, which is even more pronounced in a plasma generator with additional transformers. As noted previously, the transformers 34-36 are placed sufficiently close together so that the leakage flux from one transformer is coupled into the adjacent transformer or transformers. For example, the spacing can vary from zero, where the coils contact each other, up to one inch, for example; with the range 0.0" to 0.3" being preferred where each circuit branch is rated up to 600 watts with a 4 kilovolt secondary. The distance depends upon the power levels and the number of transformers so that even greater distances may be possible with transformers for larger power plasma generators. Due to this relatively close spacing, the fields generated by the primary coils interact with each other and the separate fields generated by the secondary coils interact with each other.

During operation of the plasma generator 30 shown in FIG. 2, the leaky coupling of the transformers aids in tuning the entire system to resonate a single frequency. Considered individually, each circuit branch 31, 21 and 33 of the plasma generator circuit typically has a different resonant frequency due to component manufacturing tolerances and variation in the dynamic operating conditions of the respective plasma discharge cell. Such resonant frequencies can differ by 15%-20% in the same plasma generator. However, the loose coupling of a given transformer allows the stray magnetic fields from the adjacent transformers to influence the resonant frequency of the circuit branch 31-33 containing the given transformer. In other words, the intentional cross coupling of the stray magnetic fields among the transformers 34-36 causes all the circuit branches 31-33 to resonate at substantially the same frequency. This enables a common inverter which produces a single excitation frequency to drive all the plasma discharge cells 37-39 efficiently, without requiring a large external choke. Therefore, the cross flux leakage coupling provided in the present invention not only compensates for manufacturing tolerance variation among the different transformers and plasma discharge cells, it also compensates for dynamic variance of the effective capacitance of each plasma discharge cell 37-39 due to fluctuations in the pressure, temperature, or flow rate of the gas being excited. That coupling also enables the use of smaller transformers for the same power rating as compared with a conventional plasma discharge devices that employ tightly coupled transformers spaced significantly apart.

Figure 7:
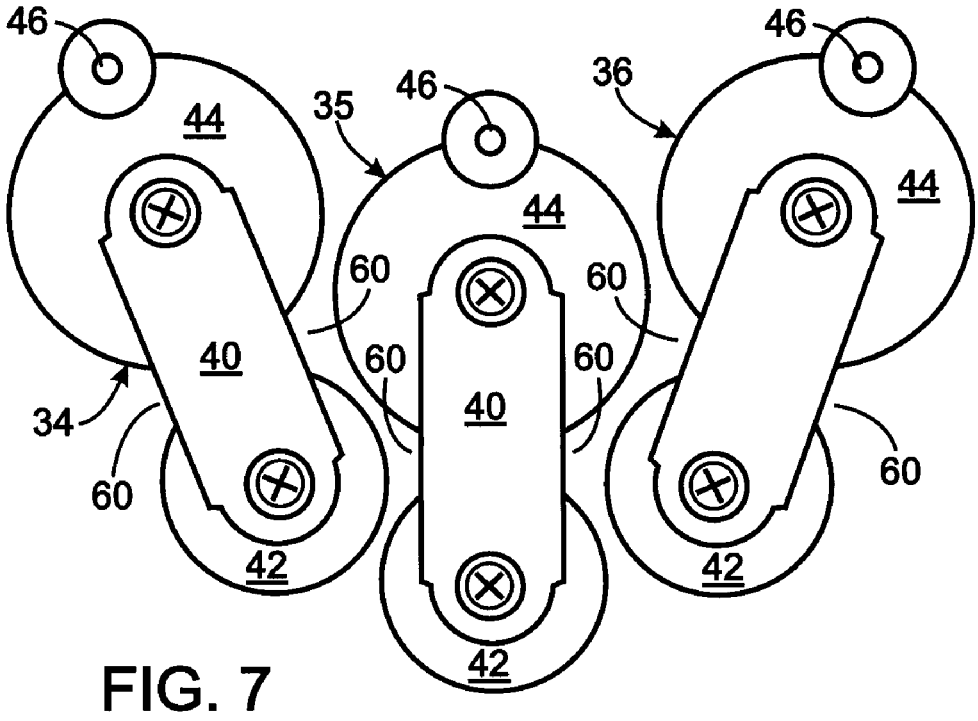
FIG. 7 is a second arrangement of three transformers.

FIG. 7 illustrates an alternative device placement in which the three transformers 37-39 nest into each other with the primary coils 42 facing in one direction and the secondary coils 44 facing in an opposite direction. Specifically, a separate recess 60 is created between the primary and secondary coils 42 and 44 on both sides of each transformer 34, 35, and 36. When the array of transformers is assembled, the secondary coil 44 of the middle transformer 35 is arranged so as to nest into the recesses 60 provided in the outside transformers 34 and 36. In addition, the primary coils 42 of those outside transformers 34 and 36 nest in the recesses 60 provided on opposite sides of the middle transformer 35. This cross couples the leakage flux among the transformers.

Figure 8:
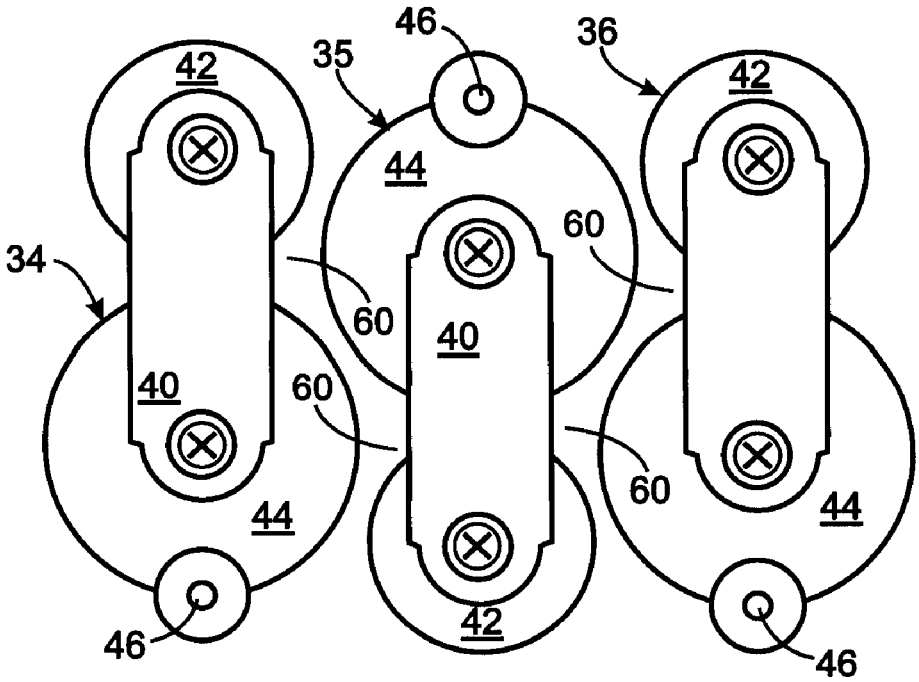
FIG. 8 illustrates a third arrangement of a plurality of transformers.

A further alternative arrangement is shown in FIG. 8, in which the outer transformers 34 and 36 are inverted with respect to the middle transformer 35. In this arrangement, the larger secondary coil 44 of each transformer fits into the recess 60 in the adjacent transformer. This third alternative, while theoretically possible, has several practical disadvantages as it requires phase compensation of the electrical signals. In addition, this structure creates a power supply that is more sensitive to the load power factors and is more difficult to manage electrically.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A plasma generator comprising:

a plurality of plasma discharge cells in which a gas is excited to produce a plasma;

a signal generator for producing an excitation signal having a high frequency; and a plurality of transformers, each having a separate ferromagnetic core, a primary coil wound on the core at a first location and connected to the signal generator, and a secondary coil wound on the core at a second location and connected to one of the plurality of plasma discharge cells thereby forming a resonant circuit having a resonant frequency, the core having a flux leakage that produces a stray magnetic field outside the core, the plurality of transformers placed in close proximity to each other so that the stray magnetic field from each transformer is coupled to at least one other transformer, thereby altering the resonant frequency of at least one resonant circuit wherein all the resonant circuits resonate at substantially an identical frequency.

2. The plasma generator as recited in claim 1 wherein the ferromagnetic core has at least one gap which produces flux leakage that aids in producing the stray magnetic field outside the core.

3. The plasma generator as recited in claim 1 wherein the ferromagnetic core has opposing first and second side legs, a first cross leg providing a flux path between each of the first and second side legs, and a second cross leg providing another flux path between each of the first and second side legs.

4. The plasma generator as recited in claim 3 wherein the primary coil is wound around the first side leg, and the secondary coil is wound around the second side leg.

5. The plasma generator as recited in claim 1 wherein the ferromagnetic core has a first U-shaped section with a first leg and a second leg, and a second U-shaped section having a third leg in a spaced apart alignment with the first leg and having a fourth leg in a spaced apart alignment with the second leg.

6. The plasma generator as recited in claim 5 wherein the primary coil is wound around the first and third legs, and the secondary coil is wound around the second and fourth legs.

7. The plasma generator as recited in claim 1 wherein the ferromagnetic core has opposing first and second side legs, wherein the primary coil is wound around the first side leg of the core and the secondary coil is wound around the second side leg of the core.

8. The plasma generator as recited in claim 7 wherein the plurality of transformers is arranged with all the secondary coils facing in one direction.

9. The plasma generator as recited in claim 7 wherein a pair of recesses is formed between the primary coil and the secondary coil in each of the plurality of transformers, and wherein one of the primary coil and the secondary coil of each transformer is located partially with one recess of an adjacent transformer.

10. The plasma generator as recited in claim 1 wherein the primary coil of each of the plurality of transformers is directly connected to the signal generator.

11. The plasma generator as recited in claim 1 wherein the signal generator is an inverter.

12. A plasma generator comprising:

a plurality of plasma discharge cells in which a gas is excited to produce a plasma and having electrodes between which a field is generated for exciting the gas;

an inverter for producing an excitation signal having a high frequency; and a plurality of transformers, each having a separate ferromagnetic core with opposing first and second side legs, a first cross leg providing a flux path between one end of each of the first and second side legs, and a second cross leg providing another flux path between another end of each of the first and second side legs, a primary coil wound around the first side leg and connected to the inverter, and a secondary coil wound around the second side leg and connected to one of the plurality of plasma discharge cells, thereby forming a resonant circuit having a resonant frequency, the core having at least one gap causing a stray magnetic field to be created outside the core, the plurality of transformers placed in close proximity to one other so that each transformer is coupled to the stray magnetic field from at least one other transformer, thereby altering the resonant frequency of at least one resonant circuit wherein all the resonant circuits resonate at substantially an identical frequency.

13. The plasma generator as recited in claim 12 wherein the ferromagnetic core has a first U-shaped section with a first section leg and a second section leg, and a second U-shaped section having a third section leg in a spaced apart alignment with the first section leg to form the first side leg, the second U-shaped section further having a fourth section leg in a spaced apart alignment with the second section leg to form the second side leg.

14. The plasma generator as recited in claim 12 wherein the plurality of transformers is arranged with all the secondary coils are adjacent each other and face in one direction.

15. The plasma generator as recited in claim 12 wherein a pair of recesses is formed between the primary coil and the secondary coil in each of the plurality of transformers, and wherein one of the primary coil and the secondary coil of each transformer is located partially with one recess of an adjacent transformer.

16. The plasma generator as recited in claim 12 wherein the primary coil of each of the plurality of transformers is directly connected to the inverter.

17. The plasma generator as recited in claim 12 wherein the primary coil and the secondary coil has a turns ratio wherein voltage across the primary coil induces a greater voltage across the secondary coil.

18. The plasma generator as recited in claim 1 wherein the primary coil and the secondary coil has a turns ratio wherein voltage across the primary coil induces a greater voltage across the secondary coil.

* * * * *